US005863713A

United States Patent [19]

Aviles

[11] Patent Number: 5,863,713

[45] Date of Patent: Jan. 26, 1999

[54] PROCESS REPEATEDLY REGENERATES DEVELOPERS

[76] Inventor: John Jay Aviles, 1 N. Lawrence Ave., Elmsford, N.Y. 10523

[21] Appl. No.: 834,564

[22] Filed: Apr. 7, 1997

[51] Int. Cl.[6] ..... G03C 5/31

[52] U.S. Cl. ..... 430/399; 430/398; 430/490

[58] Field of Search ..... 430/398, 399, 430/434, 490

[56] References Cited

U.S. PATENT DOCUMENTS

| | | | |
|---|---|---|---|
| 3,549,370 | 12/1970 | Sykes et al. | 430/419 |
| 3,627,530 | 12/1971 | Umberger | 430/363 |
| 3,713,826 | 1/1973 | Sykes et al. | 430/483 |
| 3,928,042 | 12/1975 | Karchmar et al. | 430/490 |
| 4,025,344 | 5/1977 | Allen et al. | 430/399 |
| 4,228,234 | 10/1980 | Okutsu et al. | 430/399 |
| 4,245,034 | 1/1981 | Libicky et al. | 430/399 |
| 4,741,991 | 5/1988 | Wuelfing, Jr. | 430/399 |
| 4,923,787 | 5/1990 | Harder | 430/489 |
| 5,004,676 | 4/1991 | Meckl et al. | 430/399 |
| 5,196,298 | 3/1993 | Meeus et al. | 430/440 |
| 5,252,439 | 10/1993 | Nakamura | 430/399 |
| 5,278,032 | 1/1994 | Aida et al. | 430/399 |
| 5,279,930 | 1/1994 | Green et al. | 430/399 |
| 5,346,809 | 9/1994 | Takada et al. | 430/399 |
| 5,670,304 | 9/1997 | Juers | 430/399 |

*Primary Examiner*—Hoa Van Le

[57] ABSTRACT

A repeatable regeneration process for developers comprised of introducing unremarkable sulfites or their derivatives to new and partially exhausted developers for use as a formula conditioner, base and repeatable regeneration supplement for extended development of color or B&W images utilizing silver halide or silver chloride as used in photographic materials.

1 Claim, No Drawings

PROCESS REPEATEDLY REGENERATES DEVELOPERS

BACKGROUND OF THE INVENTION

1. Field of the Invention

For use with developers and activators as a supplement, conditioner, or as the basis of a formula to be used with photographic or radiographic processes and materials, widely used in but not limited to the graphic arts, printing, photography, radiography, publishing, medical, dental, microform, science, journalism, and aerospace industries.

2. Descriptions of the Prior Art

All other prior art makes claims as preservatives to extend either storage life or aging life, not usage life, and is almost always specifically targeting or proportioned for use with either color, or B&W, using different chemicals and compounds than those of this invention, and employing either standard industry methods or different methods not relative to those of this invention.

U.S. Pat. No. 3,928,042 issued Dec. 23, 1975 claims preservative benefits through the use of salts, esters and amides of plicatic acid for the extension of storage life only. Column 2 line 50 states "The preservatives of the invention therefore achieve best results and are accordingly preferably used in photographic negative processing or with photographic stock solutions prior to their dilution for photographic paper processing". Prior to their dilution!

U.S. Pat. No. 3,549,370 issued Dec. 22, 1970 claims quaternary ammonium bisulfites, sulfites or pyrosulfites as developer preservatives. No claims are made purporting the extension of usage life but instead claims the promotion of preservative effects with all kinds of hardeners, alkalines and alkaline buffer systems.

U.S. Pat. No. 3,713,826 issued Jan. 30, 1973 claims sulfite esters as preservatives for B&W developing agents. This patent applies only to B&W developers which does not encompass color, radiographic, graphic arts materials such as lith, rapid access, hybrid chemistries, or the new fourth generation chemistries.

U.S. Pat. No. 3,627,530 issued Dec. 14, 1971 photographic developer solutions of high sulfite content and pH states usefulness in forming multicolor images in color films and in forming colored radiographic images. It also states that developer baths are stable over a long period of time but is specifically related to color photography. Stability is achieved in many ways. Stability does not mean repeatable usage life extensions. More specifically it is touted for use with "rapid access radiographic processes."

U.S. Pat. No. 5,252,439 issued Oct. 11, 1993 promotes a method of replenishing solution with replenisher and is specifically geared towards color developer replenishment. The use of two different replenishment solutions of opposing pH's are used to avoid precipitate.

U.S. Pat. No. 4,923,787 issued May. 8, 1990 photographic element containing scavenger for oxidized developing agent uses hydrazide as the scavenger and is for use in the prevention of fog and stain formation in developed color images.

U.S. Pat. No. 5,196,298 issued Mar. 23, 1993 photographic developing solution containing an ascorbic acid derivative. The developing properties of ascorbic acid have been published since the turn of the century. This invention promotes the lack of sulfite ions.

A Summary of the Claims That Have Been Made by Prior Art

Prior art promoted for use with fresh chemicals only as storage preservative.

Prior art claimed for use with partially exhausted chemicals.

Oxidation and the associated testing does not gauge or approximate usage capacity.

Most prior art specifically geared towards either color or B&W processes only.

Different chemicals employed include hydrazide and ascorbic acid.

Prior art applications designed for use with other chemicals and processes.

Prior art designed for storage or aging preservative uses only.

Prior art applicable to developers prior to their dilution.

Prior art claims long term of stability which does not imply multiple usage lives.

Prior art makes claims to the absence of sulfite ions.

OBJECTS AND ADVANTAGES OF INVENTION

Repeatable regenerating activity exemplifying the usefulness and uniqueness of this invention. This invention has consistently regenerated formulation activity levels in excess of four times normal usage life. This represents giant leap forward in the advancement of photographic technologies. And this invention has the additional benefit of immediate assimilation.

Through the course of the history of photography, its' disciplines and processes, chemists and both professional and amateur photographers have experimented with an innumerable array of chemicals and mixtures and the art has evolved to a state whereby many of the processes are common knowledge to anyone skilled in the arts.

There are still however currently emerging trends leading towards the reduction of the use of photographic chemicals in the interest of both ecology and economy. Dry process films, direct-to-plate technologies, ascorbic acid processing, and water based processing are some of the prime examples.

The problem exists however that these technologies are still emerging and have not found their way into current markets due to the high costs of research and development and the initial expenditures required to institute these technologies.

Furthermore, the market is inundated with the technology, equipment, and process knowledge of traditional photographic and radiographic processes. This fact is irrefutable and only lends itself to the conclusion that these technologies already in place will not be easily, willingly, or readily displaced.

Mankind has a tendency to rely on proven technology, and in commercial or otherwise critical situations, rightfully so. Research and development and the implementation and assimilation of these new technologies proves to be too great a burden for the majority of the populace. Small business comprising the bulk of the labor force cannot withstand the investments of time and money to be able to incorporate these technologies acquire and maintain "state of the art" status.

New technologies have not achieved the quality or cost effectiveness of traditional processes and technologies slowing the assimilation of new technologies.

My invention addresses reducing consumption of formulations, while maintaining and even increasing quality, without requiring additional capital expenditure(s) to utilize it. It works with nearly the entire scope of photographic and radiographic formulations in use today. Assimilation is instant. No additional training is required to use it and little or no recalibration of systems is required to utilize it. Photographic and radiographic chemicals and equipment maintain usefulness.

Advantages are repeatable regeneration, reducing consumption and therefore manufacture, transportation, and disposal of developers and activators promoting economy and ecology, producing finer grain, inducing and stabilizing developer activity, maintaining cleaner processors, producing more detail in the shadows, virtually eliminating algae buildup in wash waters reducing the need for highly toxic antimicrobials, the reduction of labor costs, the reduction of water usage, reducing base fog of films promoting higher resolution, the reduction of development times, conserving energy, allowing higher processing temperatures saving processing time and money, and it lends itself to the formulation of regenerable formulations.

This invention has the capacity to reduce the consumption of developers and activators to less than 25% of current volumes. As printing is the fourth large industry in the nation one can immediately see the potential benefits.

DESCRIPTION OF THE INVENTION

A supplement or base for a formula and corresponding process facilitating multiple developer usage lives and activator usage lives to be used with existing or upcoming developers, activators or formulations to achieve multiples of normal usage lives or to be used as the basis of new long life developer or activator formulations. This invention can be used in different formulations and in various strengths along with corresponding methods of use to provide multiple usage lives for most developers and activators without affecting the scope of the invention. It can also be used as either a storage preservative, an aging preservative, or both without affecting its usage life multiplying characteristics.

It can be used not only as developer or activator supplements or formula base but it can also work with either new or partially used existing or upcoming formulas.

Sulfites and their derivatives and a method of use which achieve multiple usage lives of developers and activators through said properties of said chemical(s).

PREFERRED EMBODIMENTS

The preferred embodiment of this invention is as a multiple use basis for formulations, conditioning existing formulations, and as a supplement for formulations used in the formation of images by development of B&W, color, rapid access, lith, hybrid, and next generation chemistries as used with silver halide or silver chloride in gelatin layers widely utilized in photography, and by the graphic arts industry encompassing but not limited to printing, publishing, advertising; and radiography in, but not limited to, the medical and dental professions.

DISCLOSURE

Sulfites and their derivatives and corresponding method to achieve multiple usage lives of developers and activators. The method consisting of the addition of said chemicals to either new or used preferably both—developer or activator chemistries.

Sulfites and their derivatives in any solid or liquid form including granules and liquids of various concentrations for use not only as a storage or aging preservative but the additional improvement of repeatable regeneration and restoration of activity levels of formulations after partial exhaustion to like new condition with each successive application with or without additional agents.

Sulfites and their derivatives as a formula base for conditioning formulations for the purpose of assisting successive applications to partially exhausted formulations.

Previously unattempted method of application differentiating itself from other methods whereby sulfites or their derivatives with or without additional agents are directly introduced into both fresh and partially exhausted formulations either continuously or at successive intervals and at application rates from 0.001 moles per liter to saturation thereby both conditioning formulations for regeneration and repeatedly regenerating formulations in an ongoing manner restoring activity levels to like new condition both upon original application and successive applications.

EXPLANATION OF HOW THE INVENTION WORKS

My invention employs the inherent actions of one or more said chemicals. These actions namely those of preservatives (anti-oxidants), scavengers (free radical eliminators), antimicrobials, ion replenishers (restructuring), silver solvents, and appropriate pH, to facilitate repeatedly regenerating formulations.

In addition to its ability to be used as a storage preservative and an aging preservative its most important use is as a multiple use supplement. This is contrary to previous art which only claims use as either a storage or aging preservative added during manufacturing.

Testing has shown that repeated regenerations in excess of four times normal usage life is obtainable and duplicable with my formulations and methods of use. This is accomplished by the systematic introduction of my invention. Preferably beginning with a fresh formulation, this brings the solution back to optimum capacity prior to first use. Then additional supplementations to partially used chemistries with proportionate amounts of this invention.

The recommended initial trial concentration is 1 oz/qt of a 15% solution in water of my invention to formulations. This can range from 0.001 oz/qt to maximum solubility.

The recommended starting trial interval time for the second application is 80% of the previous average life of the formulation in use prior to supplementation, but can vary widely without affecting the scope of the invention.

Some extreme examples of use include frequent periodic additions of as little as 0.01 oz/qt of said solution or the addition of approximately 4 oz/qt at longer intervals.

Replenishment tanks require higher amounts (recommended starting point of 2 oz of this invention/qt. of formulation in replenishment tank) to act as both an aging preservative for the formulation in the replenishment tank and the additional amount to be used as a supplemental regenerating agent for the partially used formulation it is replenishing.

Note

The developer or activator formulation will turn darker than ever from the natural byproducts of the reaction. An effluent is released due to the regeneration or restructuring activity and is a signature telltale sign it is working. The developer while turning darker than ever will still maintain useable activity levels which are renewable! You must test your materials for proper development for your application and not rely on developer coloration. When activity has fallen below useable levels due to saturation after several regeneration cycles simply change chemicals as usual.

SUMMARY

Sulfites and their derivatives have been used for many years as storage preservatives and aging preservatives used against oxidation but have never been exploited for the properties of repeatable regeneration. Nor have they been used in these conjunctions to even remotely achieve these results.

My invention has successfully accomplished what no other invention has achieved. And it does this at a time of great need for ecological transitions. Current markets are inundated with photographic technologies and will not be easily displaced. The many incentives for its' use include economy and ecology of global proportions, ease of use, quality results, and near universal compatibility. And it has the potential of reducing the consumption, and therefore the manufacture, transportation, and disposal to less than 25% of current volumes.

EXAMPLE SCENARIO ONE

Applications include either:

a processor utilizing solution level type replenishment, or a storage container used to store chemicals for open tray processing.

For 4.5 qts of developer which usually lasted a month before falling below useable activity levels, add approximately 4.5 oz (1oz/qt) of this invention to the fresh developer. Then as the supplemented developer approaches the first month, add another 2.25 oz (½ oz/qt) of this invention to the developing tank.

Repeat the addition of 2.25 oz of this invention to the tank at successive intervals nearing the two, three, four etc. month marks. This method currently utilizes repeatable renewal of the developer to achieve well beyond four times normal usage life!

This is not replenishment. Replenishment utilizes the original developer or a derivation thereof. This is multiple renewal and restructuring of a compound through the actions listed above namely those of preservatives (anti-oxidants), scavengers (free radical eliminators), antimicrobials, ion replenishers (restructuring), silver solvents, buffers, and appropriate pH, to facilitate multiple usage lives.

Day to day replenishment to account for evaporation and loss of developer due to carryover into the next tank is accomplished using either full working strength fresh developer or a developer replenisher solution.

EXAMPLE SCENARIO TWO

For a processor with automatic replenishment that forces overflow replenishment by pumping fresh developer usually from a 5 gal holding tank using the same 4.5 qt capacity tanks add 4.5 oz (1 oz/qt) of this invention to the processor's developing tank and 40 oz (2 oz/qt) to the holding tank. This not only acts as an aging preservative but the higher quantity of this invention works to renew the chemical structure of the developer in the tank as it is being replenished.

Then reduce the replenishment rate of the processor to approximately 25% of the previous replenishment rate depending on how critical the application is. For critical applications reduce the replenishment rate to 50% and perform necessary testing.

I claim:

1. A three stage method for procuring repeated regeneration of photographic developers, wherein the improvements consist of a combination of simplicity and device and relationship independence, yielding extreme effectiveness achieved by combining the methods of pre-treating, accounting for loss with working strength solution and not a specific replenisher, and periodic post-treatment with the recommended starting trial interval time is 80% of the previous average usage life of the original developer with the same pre-treatment solution, comprised of:

a. pre-treating developer with sulfites or their derivatives to effectively prepare solutions for successive treatments, and b. replenishment with sufficient working strength developer to account for loss, and c. procuring superadditive regenerative effects through post-treating used developer with sulfites or their derivatives, to saturation.

* * * * *